US007717385B2

(12) United States Patent
Saffray

(10) Patent No.: US 7,717,385 B2
(45) Date of Patent: May 18, 2010

(54) DEVICE COMPRISING A CONTAINER FOR BOTTLES

(75) Inventor: Jean-Charles Saffray, Reims (FR)

(73) Assignee: Veuve Clicquot Ponsardin Maison Maison Fondee en 1772, Reims (FR)

( * ) Notice: Subject to any disclaimer, the term of this patent is extended or adjusted under 35 U.S.C. 154(b) by 450 days.

(21) Appl. No.: 11/574,829

(22) PCT Filed: Aug. 26, 2005

(86) PCT No.: PCT/FR2005/002156

§ 371 (c)(1),
(2), (4) Date: Jun. 5, 2007

(87) PCT Pub. No.: WO2006/030086

PCT Pub. Date: Mar. 23, 2006

(65) Prior Publication Data

US 2007/0257174 A1 Nov. 8, 2007

(30) Foreign Application Priority Data

Sep. 8, 2004 (FR) ..... 04 09516

(51) Int. Cl.
*A47G 23/02* (2006.01)

(52) U.S. Cl. ..... 248/311.2; 248/558; 248/126

(58) Field of Classification Search ..... 248/311.2, 248/558, 213.2, 291.1, 126, 578, 645; 62/457.4, 62/457.8, 463, 464; 220/482, 480
See application file for complete search history.

(56) References Cited

U.S. PATENT DOCUMENTS 3,628,005 A * 12/1971 Rhoades ..... 362/191
4,036,463 A * 7/1977 Hopkins et al. ..... 248/210
4,418,883 A 12/1983 Cohen
4,887,784 A * 12/1989 Kayali ..... 248/311.2
5,609,318 A 3/1997 Scheh
5,996,957 A 12/1999 Kurtz
6,766,912 B1 * 7/2004 Gibbs ..... 211/74

* cited by examiner

*Primary Examiner*—Anita M King
(74) *Attorney, Agent, or Firm*—Miller, Matthias & Hull

(57) ABSTRACT

A device including a container for bottles in which the container is equipped with an opening and a base is disclosed. The device also includes a support which is equipped with a base. The support and the container are connected between a first position in which the base of the support is disposed at the opening of the container and in which the support is intended to fix the device to the edge of a table, such that the opening of the container is orientated upwards, and a second position in which the base of the support is disposed at the base of the container and is intended to be placed on the table, such as to support the container in a stable manner.

26 Claims, 10 Drawing Sheets

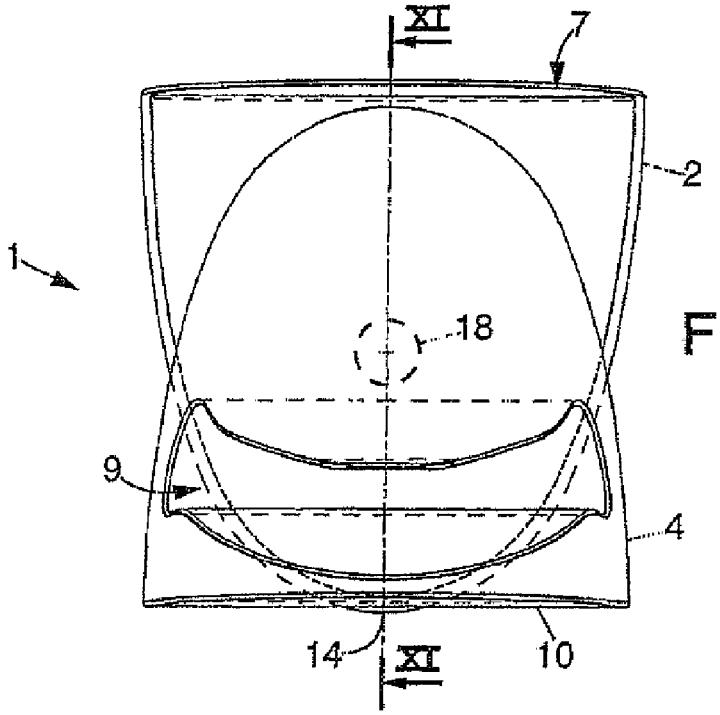
FIG. 10
FIG. 11
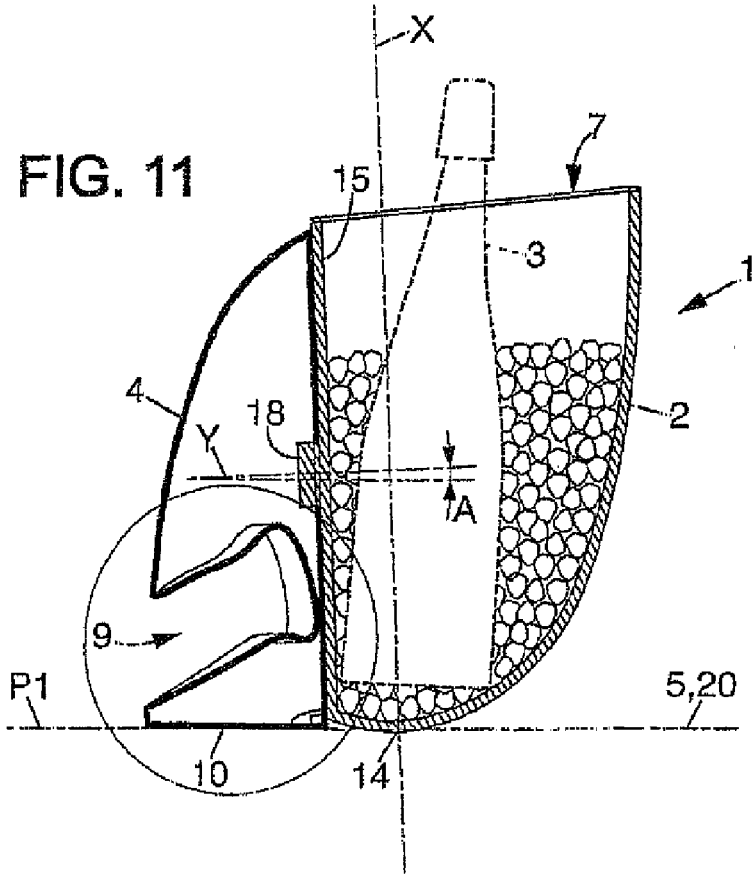

DEVICE COMPRISING A CONTAINER FOR BOTTLES

FIELD OF THE INVENTION

The present invention relates to devices comprising receptacles for bottles, which devices are intended to present and/or cool, at the table, beverages served in bottles.

More specifically, the invention relates to a device comprising a receptacle for bottles, this receptacle having an opening and a bottom, this device further comprising a support designed to hook the receptacle onto the edge of a table.

BACKGROUND OF THE INVENTION

Document U.S. Pat. No. 5,609,318 describes an example of such a device, in which the receptacle is simply stood on the support when the said receptacle is to be hooked onto the edge of a table. By contrast, if the receptacle is to be stood on a table, it is detached from its support which then, in this mode of use, is no longer of any service.

This device in particular exhibits the following disadvantages:

- the support is relatively bulky, while the device is being used and/or stored;
- and there is a risk that the support will be mislaid by the user, in which case its support is no longer available when the said user wishes to hook the device onto the edge of a table.

SUMMARY OF THE INVENTION

It is a particular object of the present invention to alleviate these disadvantages.

To this end, according to the invention, a device of the kind in question is characterized in that the support comprises a pedestal, and in that the support and the receptacle comprise means to be joined together between:

- a first position in which the pedestal of the support is positioned towards the opening of the receptacle and in which the support is designed to hook the device onto the edge of a table with the opening of the receptacle facing upwards,
- and a second position in which the pedestal of the support is arranged towards the bottom and is designed to be stood on a table supporting the receptacle in a stable manner.

By virtue of these measures, the device according to the invention may be relatively compact and also avoids mislaying the support. As the support is fixed to the receptacle, it may also make it easier for a user to take hold of the device.

In various embodiments of the invention, recourse may further be had to one and/or other of the following measures:

- the support is mounted to pivot with respect to the receptacle between the said first and second positions;
- the support is mounted to pivot with respect to the receptacle around an axis of inversion more or less perpendicular to the overall axis of the device;
- the support comprises a groove hollowed into the support on the opposite side to the receptacle, the said groove being designed for hooking the device onto the edge of a table when the support is in its first position;
- the groove is inclined with respect to a plane perpendicular to the overall axis of the device;
- the groove has an upper face equipped with an upper lip designed to press, in the first position, against a top surface of a table, and a lower face equipped with a lower lip designed to press, in the first position, against an underside of the table, the opposite side to the top surface;
- one and/or other of the lips is equipped with a non-slip surface;
- the upper lip is formed of an attached insert fixed to the said support on the same side as the upper face of the groove;
- the receptacle and the support have sidewalls which, in the first position, run in the continuation of one another;
- in the first position, the device has a truncated ovoid shape;
- in the first position, the pedestal of the support and the opening of the receptacle run in the same plane;
- the receptacle comprises a flat exterior wall on which the support is mounted to rotate;
- the said flat exterior wall is perpendicular to the said axis of inversion of the support and offset with respect to the overall axis of the device, such that the said overall axis passes through the receptacle;
- the pedestal runs in a plane and the bottom of the receptacle ends in an apex which, when the support is in the second position, is contained in this plane;
- the plane of the pedestal forms, with the said axis of inversion, a non-zero angle such that this axis approaches the plane of the pedestal in the direction away from the direction of the receptacle;
- the said angle is chosen such that the projection of the center of gravity of the said device onto the said plane of the pedestal lies in the region consisting of the pedestal and of the space between the said pedestal and the apex of the receptacle;
- the said angle lies between 3° and 10° inclusive;
- a system is provided for fixing the receptacle to the support, this system comprising hooks projecting from the flat exterior wall of the receptacle and able to clip onto a ring mounted facing them on the support;
- this fixing system comprises a circular rib projecting from the flat exterior wall of the receptacle, able to slip over an internal circular edge of the said ring;
- this fixing system further comprises tabs projecting radially from a free edge of the said circular rib and able to be introduced into cut-outs formed radially in the internal edge of the said ring;
- the fixing system comprises at least one washer interposed between the said circular rib and the said ring;
- a locking mechanism is provided for maintaining the orientation of the support, with respect to the receptacle, in either one of the said positions;
- this locking mechanism comprises a moving lock bolt mounted to slide with respect to the support between a locking position in which the lock bolt is engaged in a housing with which the receptacle is equipped, and a release position in which the lock bolt is clear of the said housing;
- the locking mechanism comprises a return spring which urges the lock bolt into its locking position;
- the lock bolt forms a push-button able to be operated manually from outside the support;
- the flat exterior wall of the receptacle has, projecting from it, a rib comprising two semicircular portions connected by two setbacks which are diametrically opposed and each form a housing able to accommodate the lock bolt of the locking mechanism.

BRIEF DESCRIPTION OF THE DRAWINGS

Other features and advantages of the invention will become apparent in the light of the description given hereinafter with reference to the attached drawings in which:

FIG. 10 is a face-on view, on X, of the device of FIG. 9;

FIG. 11 is an elevation, in section on XI-XI, of the device of FIG. 10, stood on a table;

MORE DETAILED DESCRIPTION

Figure 1:
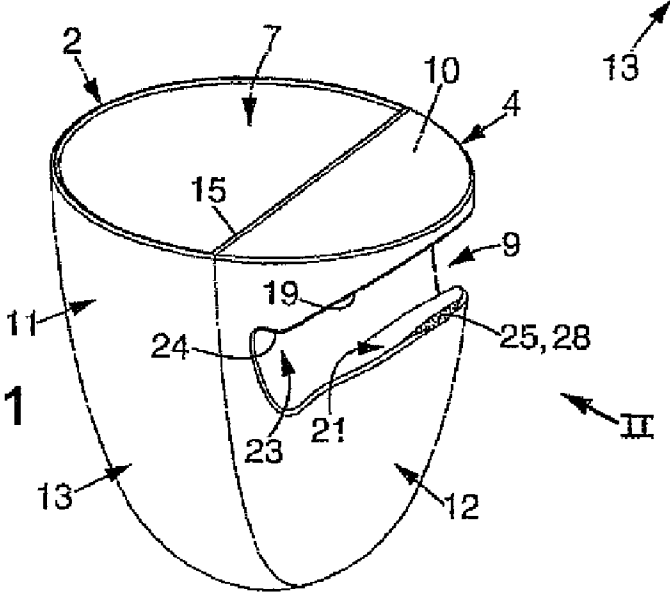
FIG. 1 is a perspective view of a device according to the invention, depicted in a position for hooking.

FIG. 1 depicts a device 1 comprising a receptacle for bottles, more commonly known as a "champagne bucket" (which is what the device 1 will be called hereinafter).

The bucket 1 comprises, on the one hand, a hollow receptacle 2 into which a bottle 3 (generally a bottle of champagne) can be introduced, in order in particular to chill it and, on the other hand, a support 4 able to allow either the bucket 1 to be rested on a table 5 or it to be hung from an edge 6 of this table.

The receptacle 2 has an opening 7, formed by an edge with a circular outline, via which the bottle 3 is introduced, and a bottom 8 against which the bottle 3 then rests.

The support 4 comprises hooking means 9, in the example in the form of a groove, to allow the bucket 1 to be hung from the edge 6 of the table 5, and a pedestal 10 to allow the bucket 1 to rest stably on the table 5.

The support 4 is fixed to the receptacle 2 while at the same time being able to move with respect to the latter so that it can be inverted about an axis Y of inversion. In this instance, the support 4 is mounted to rotate with respect to the receptacle 2 about the axis Y between a first position, known as the hooking position, illustrated in FIGS. 1 to 3, 7 and 8, and a second position, termed the standing position, illustrated in FIGS. 9 to 12, in which the support 4 has been rotated through 180° with respect to its hooking position, in other words has been inverted.

Figure 3:
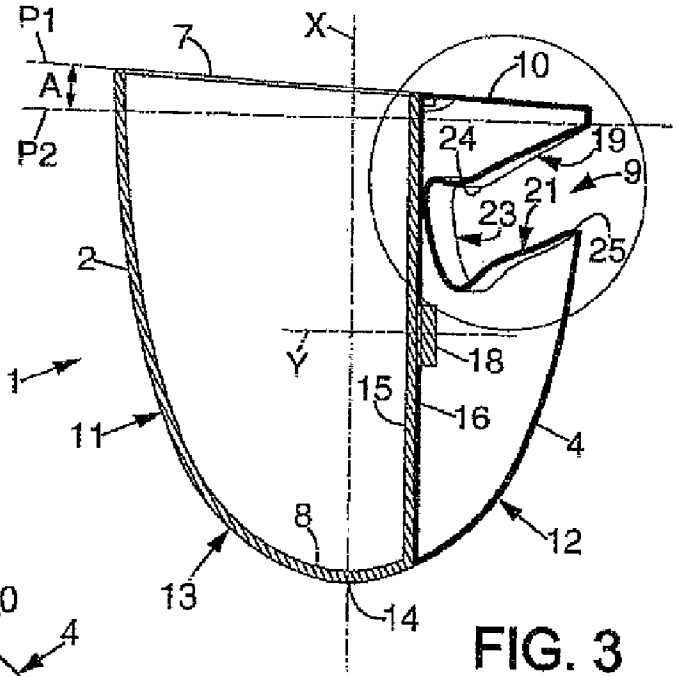
FIG. 3 is an elevation, in section on III-III, of the device of FIG. 2.
Figure 2:
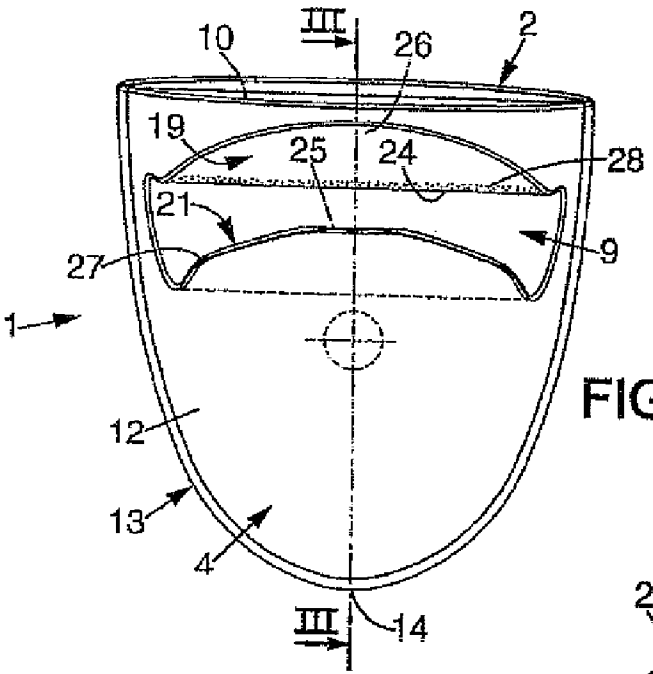
FIG. 2 is a face-on view, on II, of the device of FIG. 1.

As can be seen in FIGS. 1 to 3 in particular, the bucket 1, in the hooking position, has a truncated ovoid overall shape, the receptacle 2 and the support 4 having external sidewalls 11, 12 which run in the continuation of one another so that in this configuration the bucket 1 has an external surface 13 with a smooth appearance. As can be seen in FIGS. 2 and 3, the receptacle 2 ends, at the opposite end to the opening 7, in an apex 14.

In addition, in the hooking position, the shape of the bucket 1 is symmetric with respect to a plane containing the axis Y of inversion and passing through the apex 14. This plane of symmetry coincides, in FIG. 2, with the plane of section III-III and, in FIG. 3, with the plane of the page. In this instance, the bucket 1 has practically an exterior shape that exhibits symmetry of revolution about the main axis X contained in the plane of symmetry defined hereinabove, which axis intersects the rounded bottom 8 of the receptacle 2 at the apex 14.

The pedestal 10 is formed of a flat surface which, in the embodiment illustrated in the figures, and as is more particularly apparent from FIG. 3, runs in the same plane P1 as the opening 7 of the receptacle.

The receptacle 2 further comprises a flat exterior wall 15 which runs in a plane perpendicular to the axis Y of inversion of the support 4 and is offset with respect to the main axis X, and on which the support 4 is mounted to rotate about the axis Y of inversion.

Figure 6:
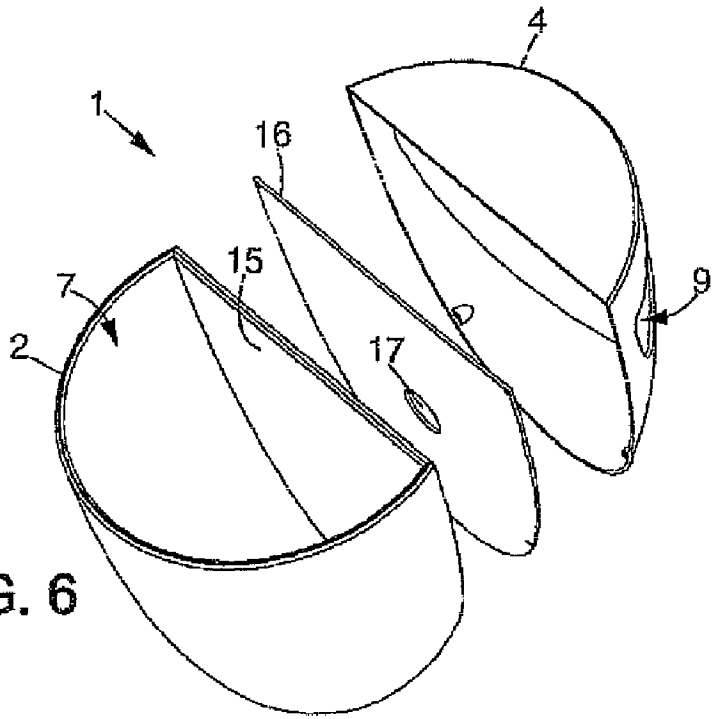
FIG. 6 is an exploded perspective view of the device of FIG. 1.

As can be seen in FIG. 6, the support 4 in this example is in the form of a one-piece shell mounted on the flat exterior wall 15 of the receptacle 2 by way of a mounting plate 16 equipped with a circular hole 17 that fits over a complementary peg 18 projecting from the flat wall 15, clearly visible in FIGS. 3, 4, 8 and 11, which embodies the axis Y of inversion of the support 4.

Figure 7:
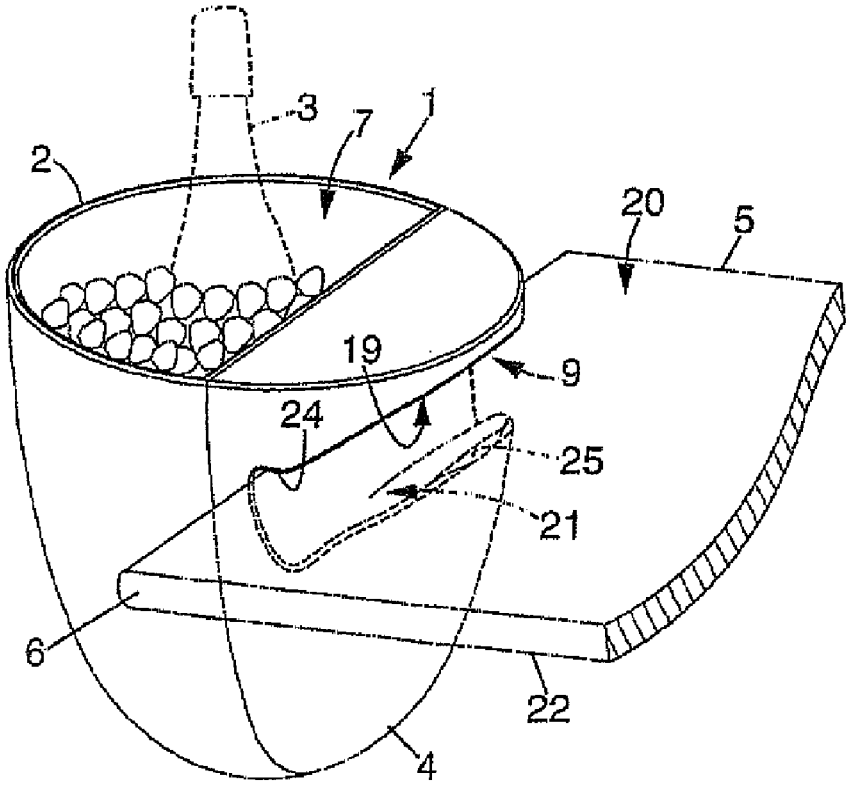
Figure 9:
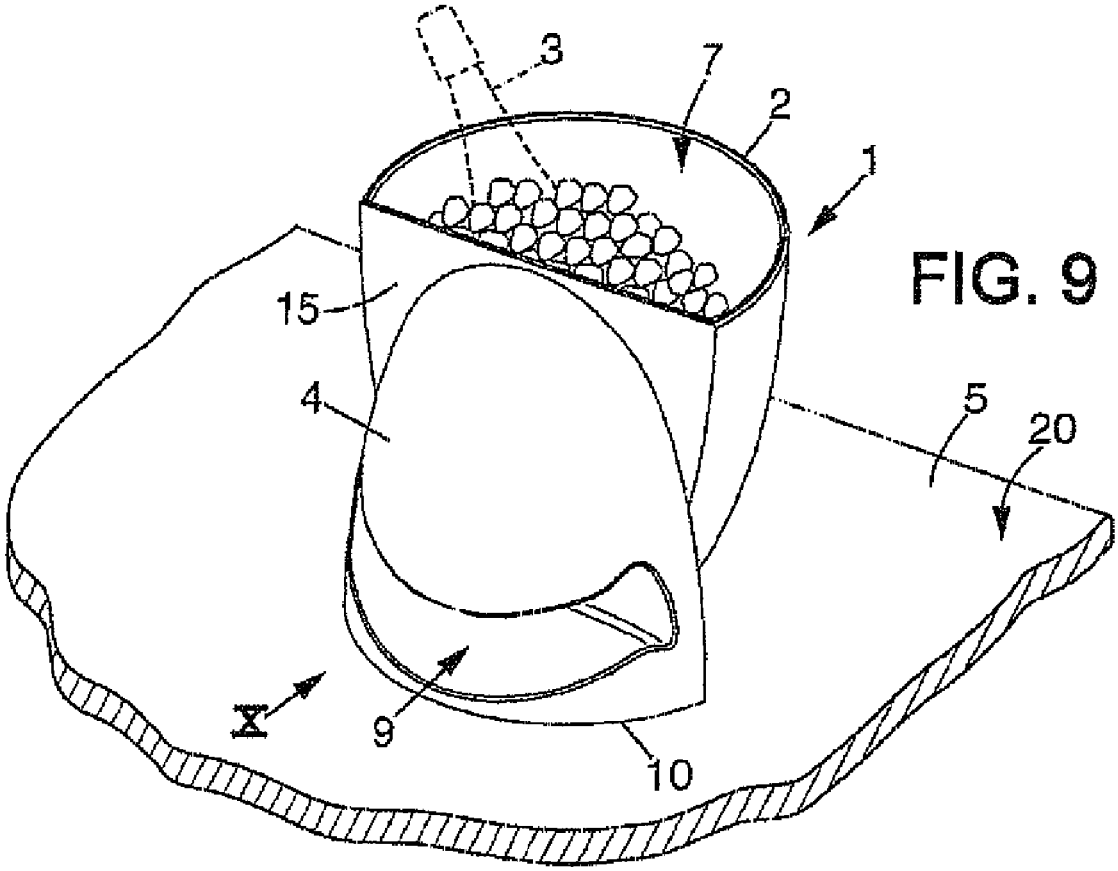
FIG. 9 is a perspective view of a device according to the invention, depicted in a position of rest in which it is stood on a table.
Figure 12:
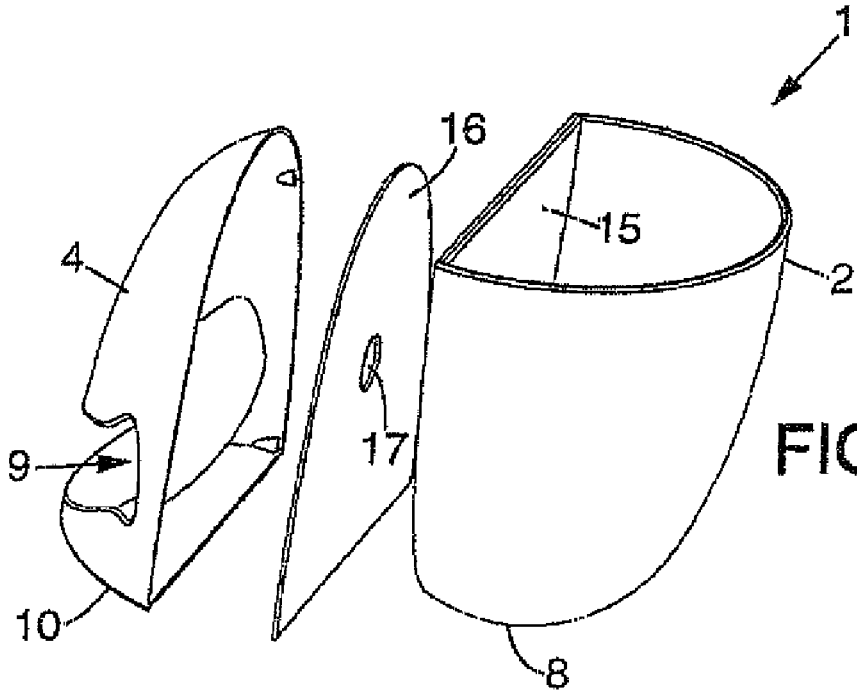
FIG. 12 is an exploded perspective view of the device of FIG. 9.
Figure 13:
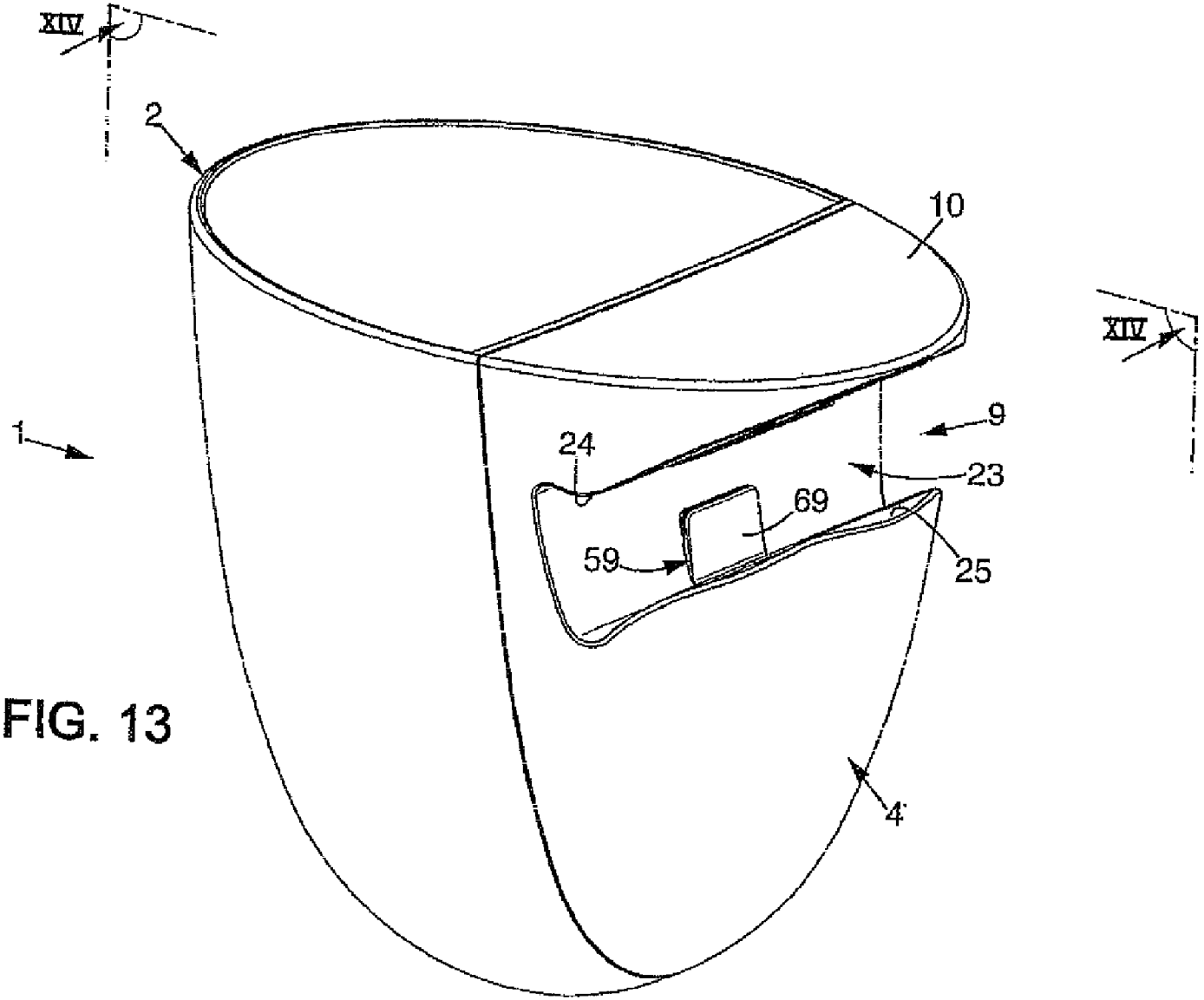
FIG. 13 is a view similar to FIG. 1 of a device according to the invention, according to an alternative form of embodiment.

It will be readily understood that, in the hooking position (FIG. 3 in particular), the ovoid shape of the bucket 1 means that it is impossible to make it remain in a stable position on the table 5 by standing it on its apex 14. In this position, the bucket 1 is in fact intended to be hung off the edge 6 of the table 5, as depicted in FIGS. 7 and 8.

The hooking means 9 allow this hanging to be done simply and reliably.

Figure 8:
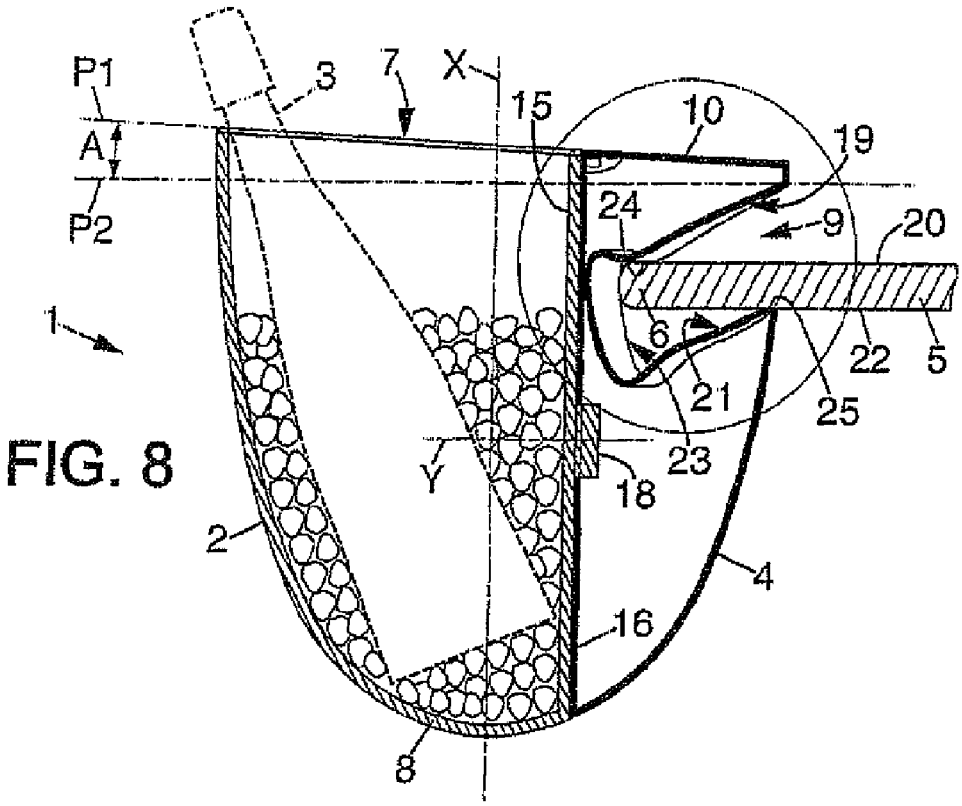
FIGS. 7 and 8 are views similar to FIGS. 1 and 3 respectively, in which the device is hung from the edge of a table.

The hooking means 9 in effect are in the form of a groove, formed as a recess in the support 4 near the pedestal 10 and comprising an upper face 19 which, when the support 4 is in the hooking position, faces the bottom 8 so that it can press against a top surface 20 of a table 5 (FIG. 8), and an lower face 21 which, when the support 4 is in the hooking position, by contrast faces towards the pedestal 10 so that it can press against an underside 22 of the table 5, the opposite side to the top surface 20 (FIG. 8).

Figure 4:
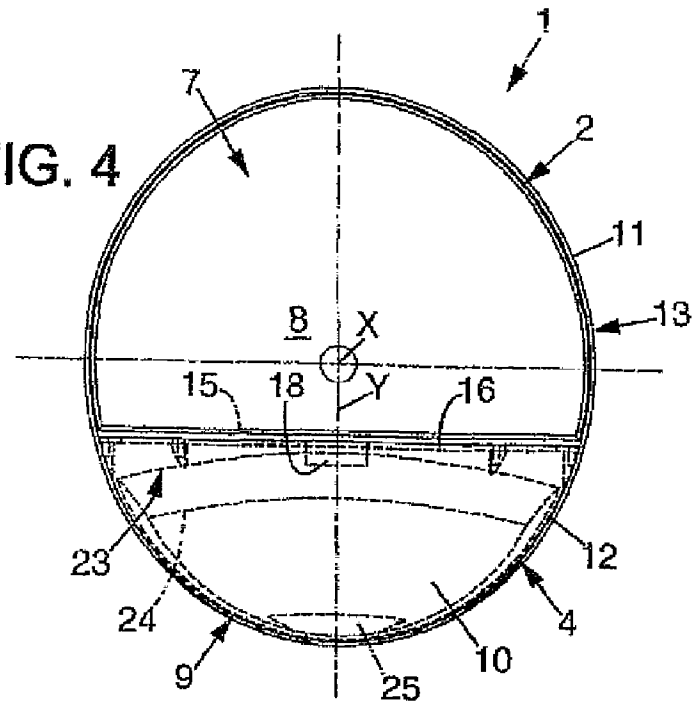
FIG. 4 is a view from above of the device of the preceding figures.

The groove 9 ends, on the same side as the receptacle 2, in a bottom 23 which, connecting the faces 19 and 21, is in the form of a more or less toric surface, the concave side of which faces away from the axis X of symmetry of the bucket (FIG. 4).

Figure 5:
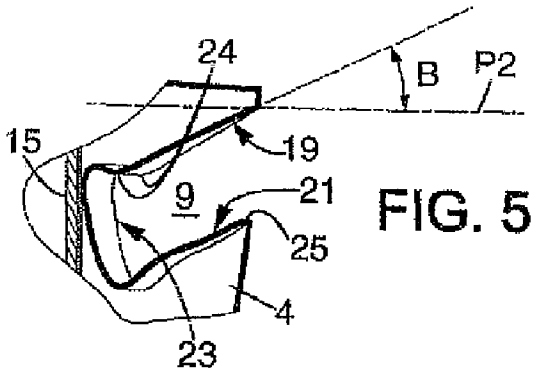
FIG. 5 is an elevation, in section, of a detail of the device of FIG. 3.

As can be seen in FIG. 3, the groove 9 is hollowed obliquely into the support 4 towards the geometric center of the bucket 1, that is to say that the faces 19 and 21, which are more or less parallel, are inclined with respect to a plane P2 perpendicular to the axis X of symmetry of the bucket, for example at an angle B, marked in FIG. 5, of between 20° and 40° inclusive (of about 25° in the example illustrated) the groove 9 being situated above the center of gravity of the bucket 1 when the bucket is considered in its hooking position (FIG. 3).

The upper face 19 is domed towards the lower face 21 to form, near the bottom 23, an upper lip 24 which, intended to form the area of contact between the upper face 21 and the top surface 20 of the table 5 (FIG. 8), runs in an arc of a circle concentric with the arc of the circle formed by the bottom of the groove 23, and does so, preferably, such that it is more or less parallel to the plane P2 (FIGS. 4 and 8).

As for the lower face 21, it has, on the edge of the groove 9, a lower lip 25 offset towards the outside of the bucket 1 with respect to the upper lip 24 and which, running parallel to the plane P2, is intended to form the area of contact between the lower face 21 and the underside 22 of the table 5 in the hooking position (FIG. 8).

Thus, in order to hang the bucket 1 from the edge 6 of a table 5, the procedure is as follows.

Holding the bucket 1 at a slight angle, the groove 9 is fitted over the edge 6 of the table 5, more or less parallel to the faces 19, 21, until the edge 6 butts up against the bottom 23 of the groove 9.

The bucket 1 is then allowed to pivot under its own weight, the edge 6 of the table 5 then finding itself clamped by a lever effect between the upper lip 24 and the lower lip 25. Because it is positioned in a cantilever fashion, the bucket grips the edge 6 of the table 5 by itself.

The shape of the groove 9, particularly the bowed shape and the length of the upper lip 24 for its part guarantees the stability of this hooking.

In this position, the axis of the bucket is more or less perpendicular to the plane of the table, the opening 7 being directed upwards. Slight angular variations are of course permitted, these all depending on the thickness of the table with respect to the width of the groove 9.

In order to place the support 4 in the standing position, all that is required is for it to be inverted, by rotating it through 180° about the axis Y of its inversion, the pedestal 10 then becoming positioned at the same end as the bottom 8 of the receptacle 2. In other words, the receptacle 2 and the support 4 are orientated top-to-tail one with respect to the other.

As can be seen in FIG. 11, the apex 14 of the receptacle 2 lies in the plane P1 of the pedestal 10, which means that the bucket 1 stood on a table 5 rests on both the pedestal 10 and the apex 14.

Furthermore, as can be seen in FIG. 11, the axis Y of inversion of the support 4 is inclined towards the plane P1 of the pedestal 10, in the opposite direction from the receptacle 2, forming with the said plane P1 an angle A of between 3° and 10° inclusive (of about 4° in the example depicted). Given this inclination, the flat exterior wall 15 of the receptacle 2, perpendicular to the axis Y, is, when the bucket 1 is resting on the table 5, inclined with respect to the top surface 20 of the table 5 (the opening 7 being, whatever the circumstances, always facing upwards). This results in an offset, in the direction of the pedestal 10, of the projection of the center of gravity of the bucket 1 onto the plane P1, but coincides with the top surface 20 of the table, and this improves the stability of this bucket. Advantageously, the angle A will be chosen such that the said projection lies in the region consisting of the pedestal 10 and of the space between the said pedestal 10 and the apex 14 of the receptacle 2.

As far as the choice of materials is concerned, this depends on the context for which the bucket 1 is intended. The bucket may be made entirely out of plastic, which will benefit its weight and the convenience of manufacturing it.

It is also possible to make the receptacle 2 and the support 4 from different materials.

Thus, according to one embodiment, the receptacle is made of a plastic, such as PVC (which may be transparent or translucent) or polycarbonate, while the support 2 for its part is made of a metallic material, such as an aluminium. This results, on the one hand, in a high-value look and, on the other hand, in the standing position, in improved stability of the bucket 1 the center of gravity of which is actually offset towards the support 4.

It should be noted that the presence of the groove 9 allows the bucket 1 to be held in just one hand, which makes it easier to handle.

Furthermore, in order to improve the grip of the bucket 1 in the hooked position, it is possible to anticipate equipping the groove 9 with a non-slip surface 28.

This non-slip surface 28 covers, for example, at least partially, the upper 19 and lower 21 faces of the groove 9, preferably at the upper 24 and lower 25 lips.

In concrete terms, it is possible to form such a non-slip surface by sand-blasting the upper 19 and lower 21 faces so as to increase their roughness and therefore their coefficient of friction against the top surface 20 and underside 22 of the table 5.

As an alternative, it is conceivable to equip the groove 9, at its regions intended to press against the table 5, with attached pads, made of a material that has a high coefficient of friction, such as a rubber. These buffers are, for example, secured by bonding or by overmoulding.

An alternative form of embodiment of the bucket 1, which is illustrated in FIGS. 13 to 19, will now be described. This alternative form has a great many points in common with the embodiment which has just been described. Hence, only the differences will be tackled. The elements that are common retain the references used previously.

Figure 14:
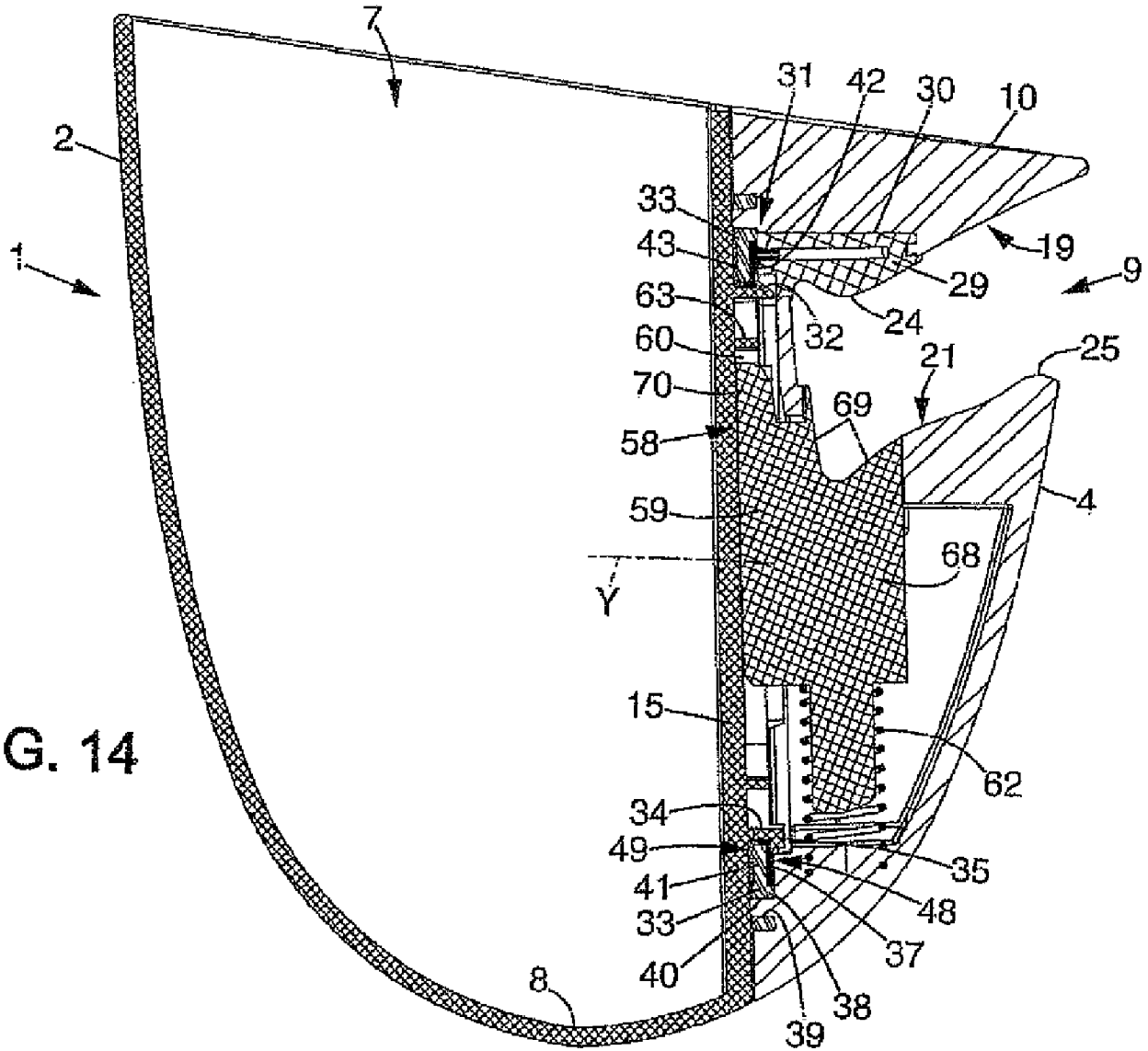
FIG. 14 is an elevation, in section, of the device of FIG. 13, on the plane of section XIV-XIV.

As can be seen in FIG. 14, the upper lip 24 here is formed of an attached insert 29, fixed to the support 4 on the same side as the upper face 19 of the groove 9 by nesting it in a complementary housing 30 hollowed into the mass of the support 4.

This insert 29 is preferably made of an elastic material exhibiting a high coefficient of friction with respect to the materials of which tabletops are conventionally made (wood, glass, metal, but also fabric). In this instance, the material chosen is an ethylene-vinyl acetate (EVA), the support 4 itself being made of aluminium. The insert 29, by virtue of its elastic material with a high coefficient of friction, prevents the bucket 1 from slipping with respect to the table on which it is hooked, while the support, because of its metallic material, gives the bucket 1 a reasonable weight which improves its stability, both when it is hooked onto a table and when it is standing on this table.

Furthermore, the bucket 1 comprises a fixing system 31 for fixing the receptacle 2 to the support 4, which system, at the same time, allows the support 4 to be rotated with respect to the receptacle 2 about the axis Y of inversion.

The fixing system 31 comprises hooks 32 projecting from the flat exterior wall 15 of the receptacle 2 and able to clip onto a circular ring 33 mounted, facing them, on the support 4.

Figure 15:
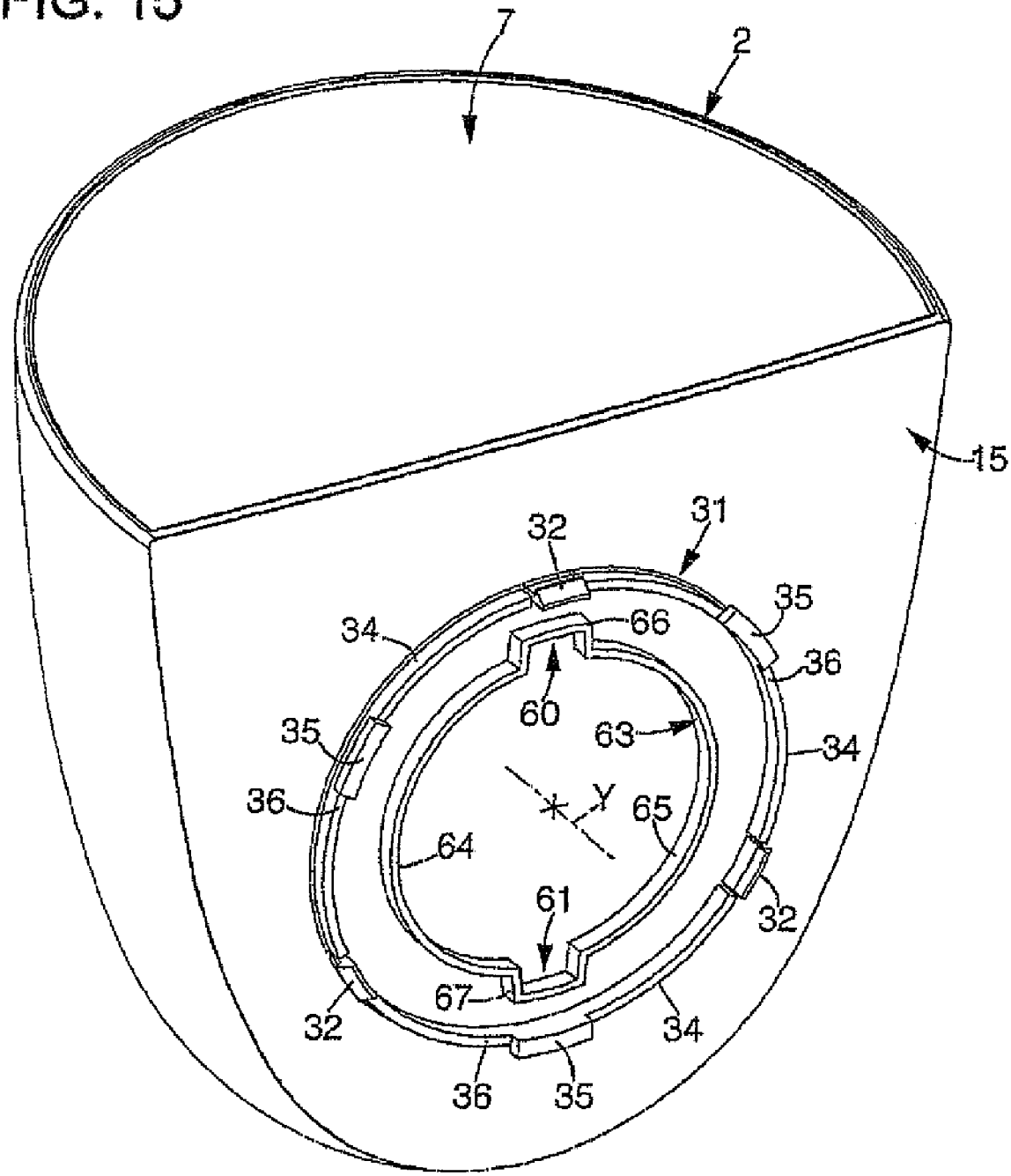
FIG. 15 is a perspective view of a receptacle for the device of FIG. 14.
Figure 19:
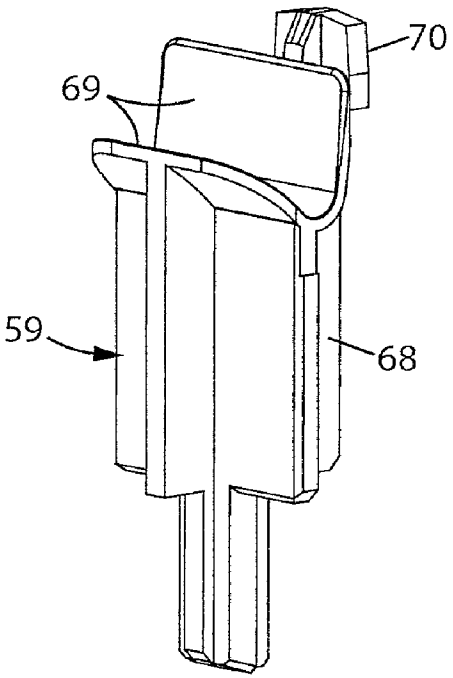
FIG. 19 is an isolated view of a lock bolt that forms part of a locking mechanism with which the device of FIG. 14 is equipped.

As can be seen in FIG. 15, there are, in the example illustrated, three hooks 32 distributed at 120° about the geometric axis Y of rotation.

A circular rib 34 termed the primary rib projecting from the flat wall 15 joins the hooks 32. This primary rib 34 is equipped with tabs 35 which project radially from a free edge 36 of the primary rib 34.

As for the zing 33, it is intended to fit into a complementary housing 37 formed in the support 4 facing the flat wall 15, and has an external portion 38 pierced with holes 39 in which positioning pegs 40 projecting from the support 4 in the bottom of the housing 37 engage. When the ring 33 is thus fitted into its housing 37, its axis of revolution coincides with the axis Y of inversion of the support 4 with respect to the receptacle 2.

The ring 33 also has an internal portion 41 which radially extends the external portion 38 towards the axis of revolution of the ring 33. The internal portion 41 has a lesser thickness than the external portion 38, so as to form, on each side, two counterbores 42, 43, termed the internal counterbore 42 and the external counterbore 43, respectively, and the purpose of which will become apparent in that which follows.

Figure 16:
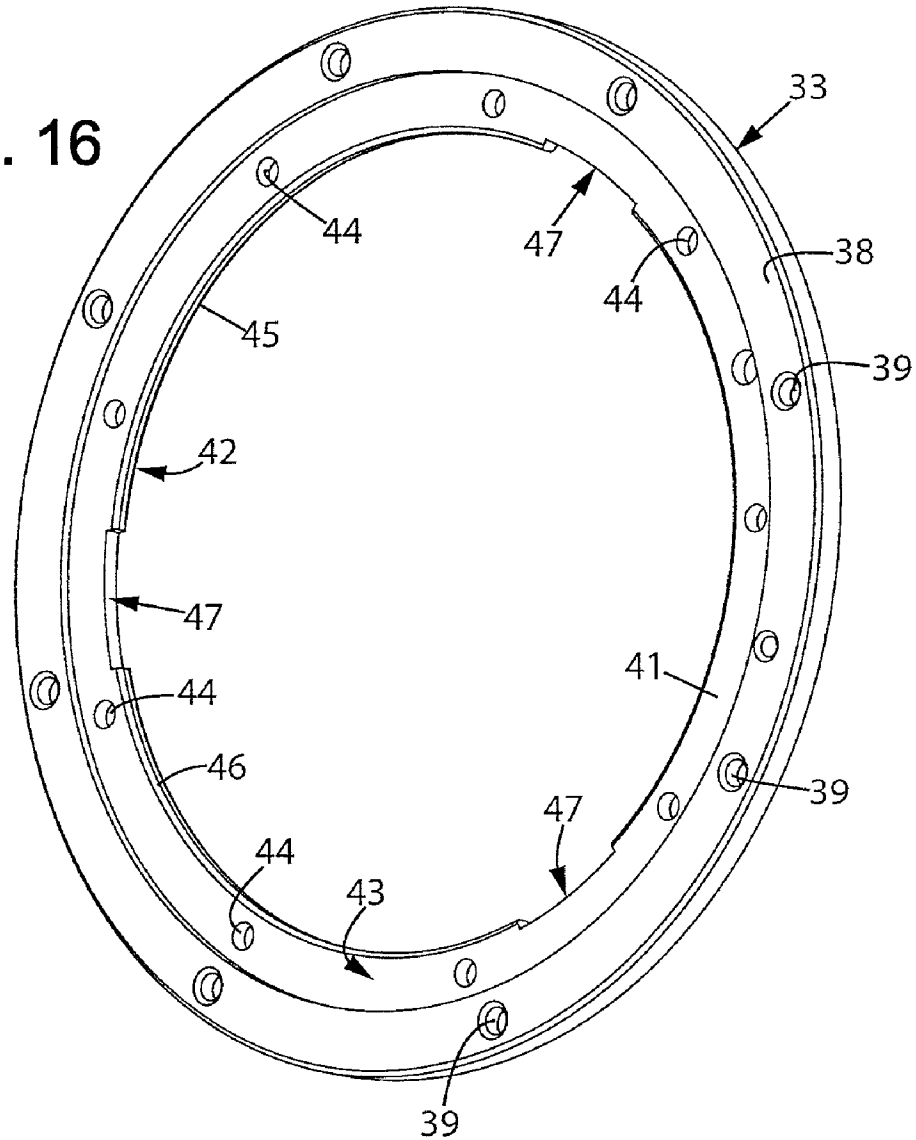
FIG. 16 is a perspective view of a ring with which the support of the device of FIG. 14 is equipped, forming part of the system for fixing the receptacle to the support of the device.

The internal portion 41 is pierced, on its circumference, with a series of holes 44; it has a circular internal edge 45 equipped on its periphery with a chamfer 46, cut-outs 47 being formed radially in the edge 45. As can be seen in FIG. 16, the cut-outs 47 are three in number and are distributed at 120° about the axis of revolution of the ring 33.

The ring 33 here is made of a metallic material, preferably of aluminium.

Furthermore, as depicted in FIG. 14, the fixing system 31 comprises an internal washer 48 intended to be interposed between the ring 33 and the support 4, and an external washer 49 intended to be interposed between the ring 33 and the flat exterior wall 15 of the receptacle 2.

The internal washer 48 has a radial portion 50 fitting onto the internal portion 41 of the ring 33 on the same side as the internal counterbore 42, extended by an axial portion 51 which fits onto the internal edge 45 of the ring 33.

The external washer 49, like the internal washer 48, has a radial portion 52 that fits over the internal portion 41 of the ring 33 on the same side as the external counterbore 43, extended by an axial portion 53 which fits over the internal edge 45 of the ring 33 in the continuation of the axial portion 51 of the internal washer 48.

The external washer 49 comprises, on its circumference, a series of bushings 54 projecting from its radial portion 52 and which fit into the holes 44 while the internal washer 48 comprises, on its circumference, a series of pegs 55 which, introduced into the holes 44, clip into the bushings 54 so that the washers 48, 49 together sandwich the internal portion 41 of the ring 33.

Figure 18:
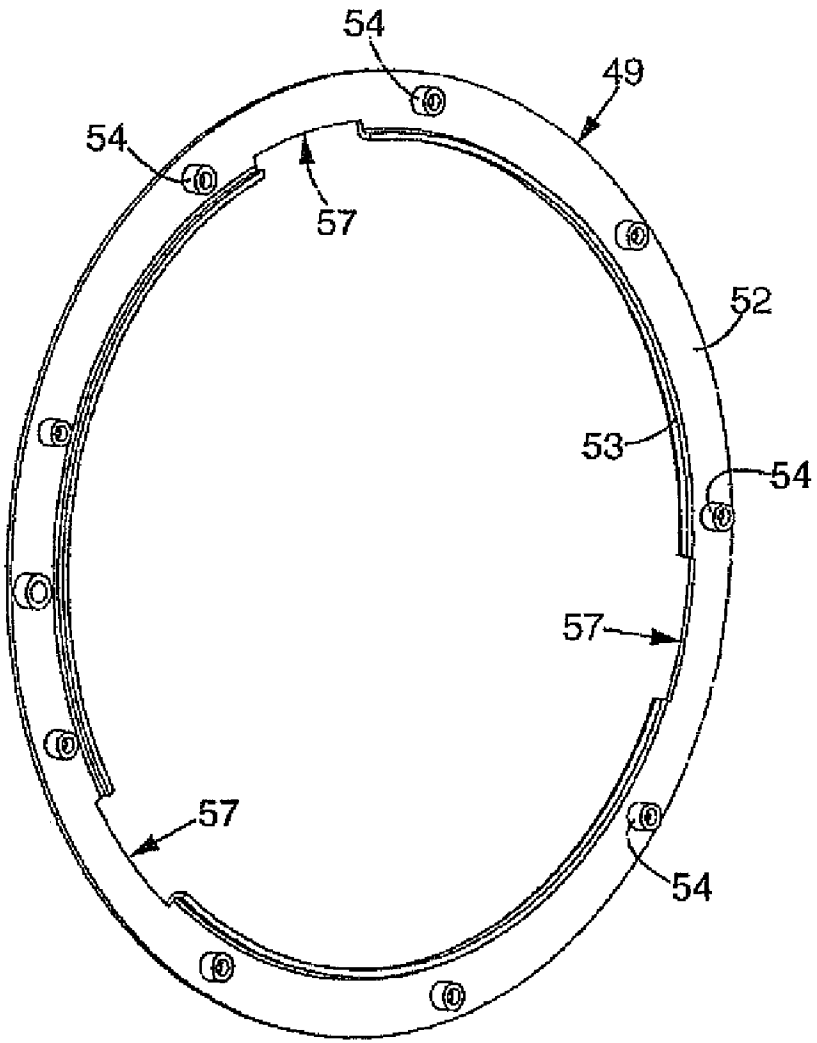
FIGS. 17 and 18 are perspective views of washers intended to be mounted on the ring of FIG. 16.
Figure 17:
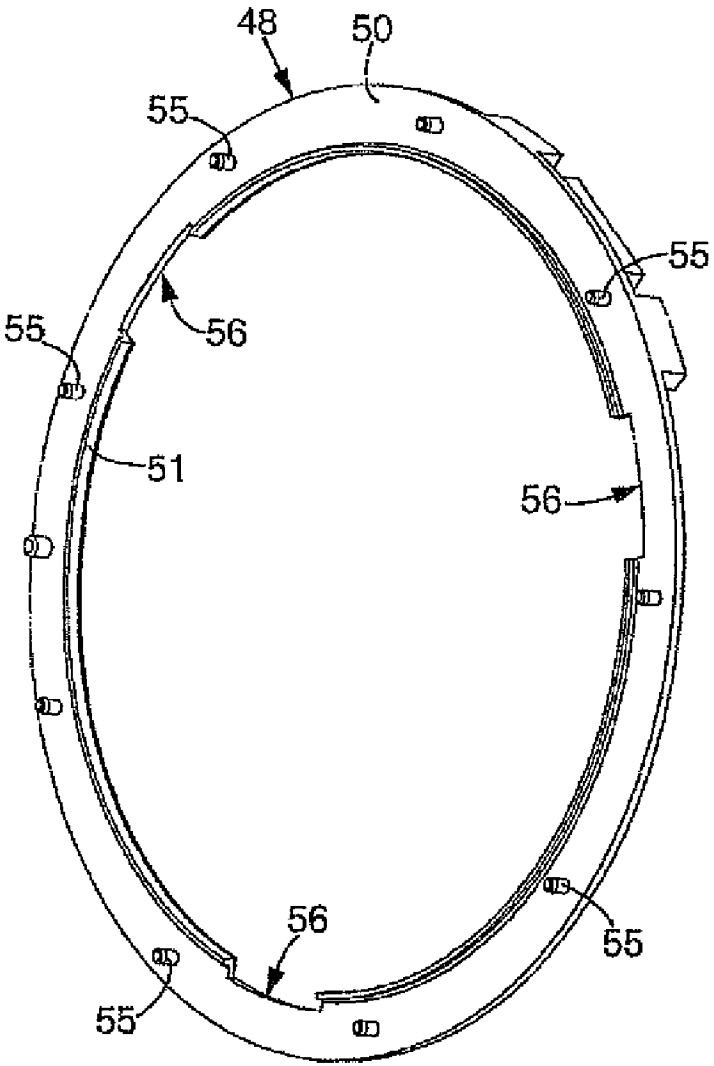

As can be seen in FIGS. 17 and 18, the washers 48, 49 are equipped with cut-outs 56, 57 formed radially in their respective radial portions 50, 52.

The cut-outs 56, 57 of which there are three for each washer 48, 49, distributed at 120°, are positioned on each side of and in alignment with the cut-outs 47 formed in the ring 33.

Thus, the receptacle 2 is fixed to the support 4 as follows.

To begin with, the washers 48, 49 are assembled on the ring 33 by fitting them onto each side of this ring, the pegs 55 clipping into the bushings 54 through the holes 39.

The ring 33 is then fitted into its housing 37, the ring 33 being fixed to the support by screw-fastening fox example.

The receptacle 2 is then fitted onto the support 4, by placing the tabs 35 in line with the cut-outs 47, 56, 57 then by pressing the receptacle 2 against the ring 33. The tabs 35 are then introduced into the cut-outs 47, 56, 57, while the hooks 32 slide, flexing, against the axial portion 53 of the external washer 49 before clipping onto the axial portion 51 of the internal washer 48.

The receptacle 2 is thus permanently fixed to the support 4, the hooks 32 and the tabs 35 being engaged with the axial portion 51 of the internal washer 48 while the primary rib 34 slides against the axial portions 51, 53 of the washers 48, 49, the radial portion 52 of the external washer 49 for its part sliding against the flat exterior wall 15 of the receptacle 2.

The material of the washers 48, 49 is chosen to minimize friction against the flat exterior wall 15 of the receptacle 2 and against the primary rib 34. It is preferably polytetrafluoroethylene (PTFE, also known by the trade name TEFLON®), the non-stick properties of which are well known.

Furthermore, as depicted in FIG. 14, the bucket 1 comprises a locking mechanism 58 intended to maintain the orientation of the support 4, with respect to the receptacle 2, in either one of the hooking or standing positions.

This locking mechanism 58 comprises a moving lock bolt 59, mounted to slide with respect to the support 4 between a locking position (FIG. 14) in which the lock bolt 59 is engaged in a housing 60, 61 with which the receptacle 2 is provided, and a release position in which the lock bolt 59 is clear of this housing 60, 61. A return spring 62, bearing against the support 4, urges the lock bolt 59 towards its locking position.

Furthermore, as can be seen in FIG. 15, the flat wall 15 has, projecting from it, a secondary rib 63, concentric with the primary rib 34 and of a smaller diameter than the latter. This secondary rib 63 comprises two semicircular portions 64, 65 connected by two setbacks, namely an upper setback 66 and a lower setback 67 which are diametrically opposed and respectively form an upper housing 60 and a lower housing 61 as mentioned hereinabove, designed to accommodate the lock bolt 59 depending on the position of the support 4 with respect to the receptacle 2.

More specifically, the lock bolt 59 comprises a body 68 exhibiting a bearing surface 69 which, as visible in FIG. 14, forms part of the lower face 21 and of the bottom 23 of the groove 9. The body 68 is equipped, on the same side as the receptacle 2, with a head 70 which constitutes that part of the lock bolt 59 that is intended to collaborate with the housings 60, 61.

The lock bolt 59 forms a push-button that can be operated manually from outside the support 4: specifically, its bearing surface 69 is accessible to the hands of a user wishing to change the orientation of the support 4 with respect to the receptacle 2.

Thus, starting out from the standing position of the support 4 (in which the head 70 of the lock bolt 59 is engaged with the upper housing 60), all the user has to do is introduce his hand into the groove 9 then press on the bearing surface 69 so as to move the lock bolt 59 into its release position until the head 70 is clear of the upper housing 60. The user then rotates the support 4 with respect to the receptacle 2. During rotation, there is no need for the user to continue to press on the lock bolt 59 as the latter is kept in its release position by one or other of the semicircular portions 64, 65 (depending on the direction of rotation) against which the head 70 presses and slides.

When the support 4 has rotated through 180°, the head 70 comes into line with the lower housing 61 into which it clips under the action of the return spring G2.

As the lock bolt 59 rubs against the flat wall 15 (particularly since the head 70 rubs against the secondary rib 63), a material will preferably be chosen for its manufacture that has a low coefficient of friction with respect to plastics (we have seen that the receptacle is made of PVC or of polycarbonate). Thus, in this instance, the lock bolt 59 is made of polyamide.

The alternative form of embodiment which has just been described displays the same advantages as the embodiment described hereinabove. However, this alternative form also allows the relative position of the receptacle 2 and of the support 4 to be kept fixed when the support is occupying one of its hooking or standing positions, as long as the user does not do anything to alter this position. This avoids the risks of unwanted pivoting of the receptacle 2 with respect to the support 4, particularly under the weight of a bottle.

The invention claimed is:

1. Device comprising a receptacle for bottles, this receptacle having an opening and a bottom, this device further comprising a support designed to hook the receptacle onto the edge of a table, wherein the support comprises a pedestal, and wherein the support and the receptacle comprise means to be joined together between:

a first position in which the pedestal of the support is positioned towards the opening of the receptacle and in which the support is designed to hook the device onto the edge of the table with the opening of the receptacle facing upwards, and a second position in which the pedestal of the support is arranged towards the bottom and is designed to be stood on the table supporting the receptacle in a stable manner.

2. Device according to claim 1, in which the support is mounted to pivot with respect to the receptacle between the said first and second positions.

3. Device according to claim 2, in which the support is mounted to pivot with respect to the receptacle around an axis (Y) of inversion more or less perpendicular to the overall axis (X) of the device.

4. Device according to claim 1, in which the support comprises a groove hollowed into the support on the opposite side to the receptacle, the said groove being designed for hooking the device onto the edge of the table when the support is in its first position.

5. Device according to claim 4, in which the groove is inclined with respect to a plane (P2) perpendicular to the overall axis (X) of the device.

6. Device according to claim 4, in which the groove has an upper face equipped with an upper lip designed to press, in the first position, against a top surface of the table, and a lower face equipped with a lower lip designed to press, in the first position, against an underside of the table, the opposite side to the top surface.

7. Device according to claim 6, in which the said upper lip is formed of an attached insert fixed to the said support on the same side as the upper face of the groove.

8. Device according to claim 6, in which at least one of the upper and lower lips is equipped with a non-slip surface.

9. Device according to claim 1, in which the receptacle and the support have sidewalls which, in the first position, run in the continuation of one another.

10. Device according to claim 9, which, in the first position, has a truncated ovoid shape.

11. Device according to claim 1, in which, in the first position, the pedestal and the opening of the receptacle (run in the same plane (P1).

12. Device according to claim 1, in which the pedestal runs in a plane (P1) and in which the bottom of the receptacle ends in an apex which, when the support is in the second position, is contained in this plane (P1).

13. Device according to claim 12, in which said plane (P1) of the pedestal forms, with the axis (Y) of inversion, a non-zero angle (A) such that this axis approaches the plane of the pedestal in the direction away from the direction of the receptacle.

14. Device according to claim 13, in which the said angle (A) is chosen such that the projection of the center of gravity of the said device onto the said plane (P1) of the pedestal lies in the region consisting of the pedestal and of the space between the said pedestal and the apex of the receptacle.

15. Device according to claim 13, in which the angle (A) lies between 3° and 10° inclusive.

16. Device according to claim 1, in which the receptacle comprises a flat exterior wall on which the support is mounted to rotate.

17. Device according to claim 16, in which the said wall is perpendicular to the axis (Y) of inversion of the support and offset with respect to the overall axis (X) of the device, such that the said overall axis (X) passes through the receptacle.

18. Device according to claim 16, which comprises a system for fixing the receptacle to the support, this system comprising hooks projecting from the flat exterior wall of the receptacle and able to clip onto a ring mounted facing them on the support.

19. Device according to claim 18, in which the said fixing system comprises a circular rib projecting from the flat exterior wall of the receptacle, able to slip over an internal circular edge of the said ring.

20. Device according to claim 19, in which the said fixing system further comprises tabs projecting radially from a free edge of the said circular rib and able to be introduced into cut-outs formed radially in the internal edge of the said ring.

21. Device according to claim 18, in which the said fixing system comprises at least one washer interposed between the said circular rib and the said ring.

22. Device according to claims 1, which comprises a locking mechanism able to maintain the orientation of the support, with respect to the receptacle, in either one of said positions.

23. Device according to claim 22, in which the said locking mechanism comprises a moving lock bolt mounted to slide with respect to the support between a locking position in which the lock bolt is engaged in a housing with which the receptacle is equipped, and a release position in which the lock bolt is clear of the said housing.

24. Device according to claim 23, in which the locking mechanism comprises a return spring which urges the lock bolt into its locking position.

25. Device according to claim 23, in which the said lock bolt forms a push-button able to be operated manually from outside the support.

26. Device according to claim 23, in which the receptacle comprises a flat exterior wall on which the support is mounted to rotate, which wall has, projecting from it, a rib comprising two semicircular portions connected by two setbacks which are diametrically opposed and each form a housing able to accommodate the lock bolt of the locking mechanism.

* * * * *